US005345704A

United States Patent [19]

Guillot et al.

[11] Patent Number: 5,345,704

[45] Date of Patent: Sep. 13, 1994

[54] STEAM IRON WITH REMOVABLE CALCIFICATION RECEPTACLE

[75] Inventors: Gerard L. H. Guillot, Radon; Jean-Paul A. Bouleau, Champfleur, both of France

[73] Assignee: Moulinex (Societe Anonyme), Bagnolet, France

[21] Appl. No.: 62,184

[22] Filed: May 17, 1993

[30] Foreign Application Priority Data

May 15, 1992 [FR] France ..... 92 05930

[51] Int. Cl.[5] ..... D06F 75/18

[52] U.S. Cl. ..... 38/77.83

[58] Field of Search ..... 38/77.3, 77.8, 77.82, 38/77.83, 81, 88, 91, 93, 94; 219/245

[56] References Cited

U.S. PATENT DOCUMENTS

| | | | |
|---|---|---|---|
| 2,313,382 | 3/1943 | Kistner | 38/77.83 |
| 2,637,126 | 5/1953 | Fitzsimmons | 38/77.83 |
| 3,045,371 | 7/1962 | Kurlinski | 38/77.83 X |
| 3,280,260 | 6/1974 | Flowers | 38/93 |
| 3,869,816 | 3/1975 | Busby | 38/77.83 |
| 4,125,953 | 11/1978 | Colombo | 38/77.83 X |

FOREIGN PATENT DOCUMENTS

| | | | |
|---|---|---|---|
| 0281987 | 9/1988 | European Pat. Off. | 38/93 |
| 2462507 | 3/1981 | France | 38/93 |
| 2010927 | 7/1979 | United Kingdom . | |

*Primary Examiner*—Clifford D. Crowder
*Assistant Examiner*—Ismael Izaguirre
*Attorney, Agent, or Firm*—Young & Thompson

[57] ABSTRACT

An electric steam iron comprises a casing (1) whose rear provides a heel (2) and a sole (3) heated by an electric resistance (4), and is adapted to occupy two positions, either an ironing position in which it rests on the sole (3), or a rest position in which it rests on the heel (2). The sole (3) has a partition (5) forming with a closure plate (6) a vaporization chamber (7) which is supplied with water from a reservoir (8) and which, on the one hand, communicates with a steam distribution chamber (9) having outwardly opening steam distribution openings (10), and, on the other hand, comprises a so-called de-scaling opening (11) opening into a rear portion of the iron and closed by a removably mounted closure. The closure is a removable receptacle (12) for recovery of calcified deposit communicating by a weir (13) with a vaporization chamber (7), so that the calcified deposit present in the vaporization chamber (7) falls into the receptacle (12) particularly when the iron occupies its rest position.

10 Claims, 3 Drawing Sheets

STEAM IRON WITH REMOVABLE CALCIFICATION RECEPTACLE

FIELD OF THE INVENTION

The invention relates to an electric steam iron comprising a casing whose rear forms a heel and a sole heated by an electric resistance, and which can occupy two positions, either an ironing position in which it rests on the sole, or a rest position in which it rests on the heel, the sole having an enclosure forming with a closure plate, a steam chamber which is supplied with water from a reservoir and which on the one hand is in communication with a steam distribution chamber having steam distribution openings that open outwardly, and, on the other hand, comprise a so-called de-scaling opening which opens into a rear portion of the iron and is closed by removably mounted closure means.

BACKGROUND OF THE INVENTION

In known devices of this type, the closure means are constituted by a plug and the de-scaling opening is adapted to permit the introduction of a tool within the vaporization chamber. The user can thus, with the aid for example of a screwdriver, scrape the walls of the vaporization chamber so as to achieve mechanical de-scaling. The drawback of these devices resides in the fact that the user, not seeing the calcified deposit within the chamber, scrapes hard and randomly and so does not cover all the surface of the chamber, and particularly the forward portion of said chamber which is the least accessible. Scaling is therefore incomplete. Moreover, he scores the internal surface of the chamber which is generally provided with a cemented coating to improve vaporization, thus destroying the coating. On the other hand, between each de-scaling operation and during the different thermal cycles, the small calcified scales come loose and pass into the distribution chamber, eventually blocking the distribution openings.

SUMMARY OF THE INVENTION

The invention has for its object to overcome these drawbacks and in particular to provide an iron permitting easy and continuous descaling while being of low cost.

According to the invention, the closure means comprise a removable receptacle for collecting the calcified deposits communicating by a weir with the vaporization chamber, such that the calcified deposit present in the vaporization chamber falls into the receptacle particularly when the iron occupies its rest position.

Thus, thanks to the recovery receptacle for calcified deposits, there is obtained a continuous and automatic de-scaling of the vaporization chamber. Thus, each time the user rests the iron on its heel, the calcified scales formed in the vaporization chamber fall into the receptacle in which they are stored until the user removes the receptacle to empty it. It is thus avoided that the calcified scale passes into the distribution chamber and blocks the distribution openings. Moreover, the user does not need a tool to ensure efficacious de-scaling. The vaporization chamber can thus have any shape with corners and weirs conventionally used to obtain the best vaporization because it is not necessary that all the extent of said chamber be accessible to a tool from the de-scaling opening.

Moreover, this device can be adapted to existing soles of irons, which are inexpensive because they can be formed by molding.

BRIEF DESCRIPTION OF THE DRAWINGS

The characteristics and advantages of the invention will become apparent from the following description, given by way of example, with reference to the accompanying drawings, in which.

DETAILED DESCRIPTION OF THE INVENTION

Figure 1:
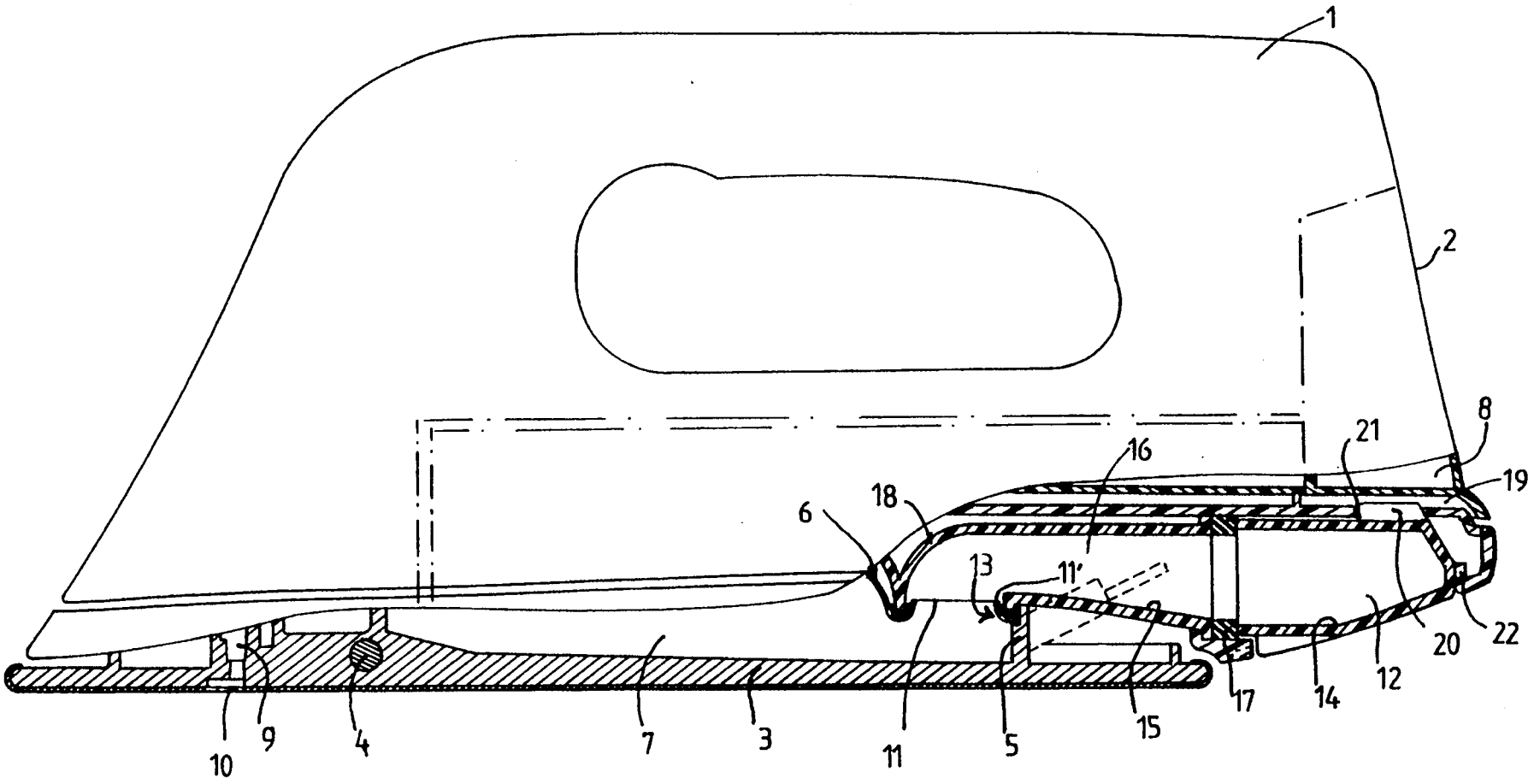
FIG. 1 is a fragmentary cross-sectional schematic view of an iron according to the invention.
Figure 2:
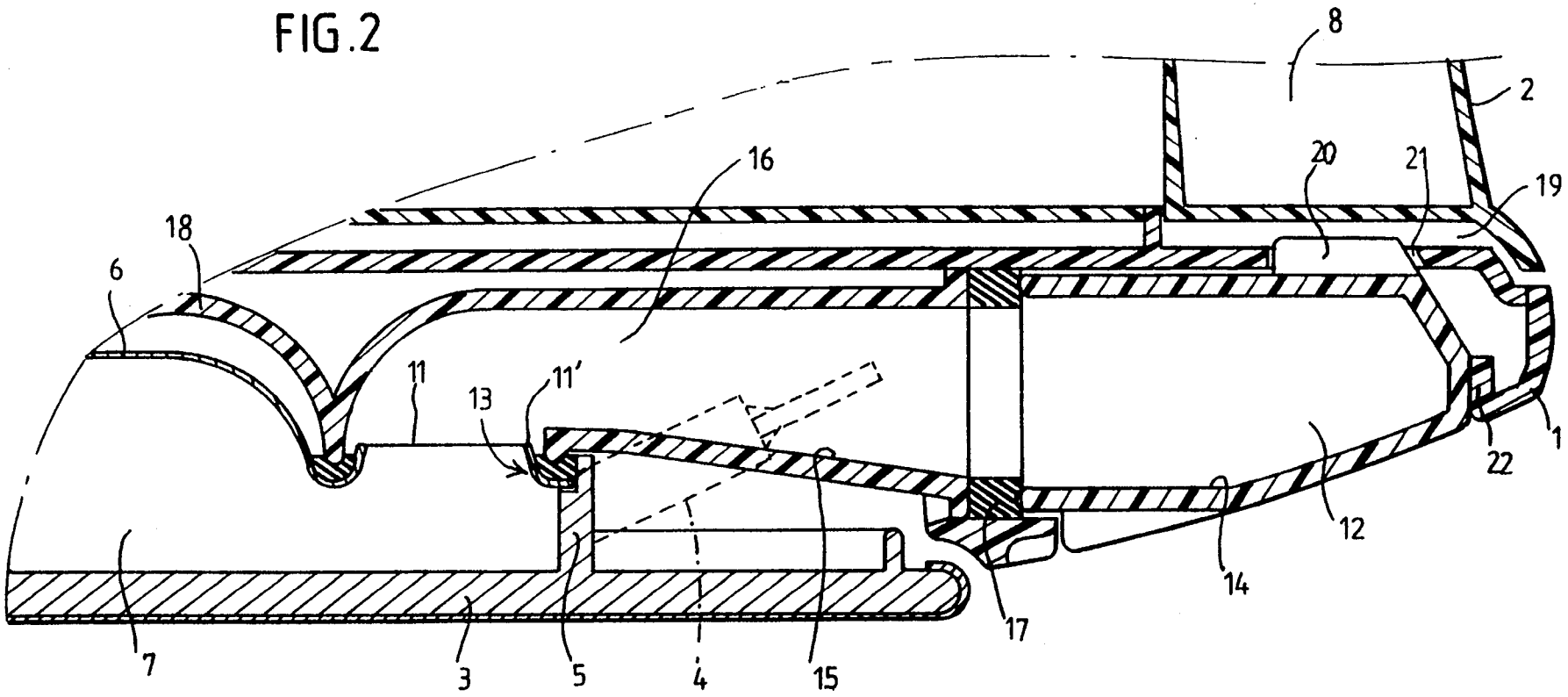
FIG. 2 is a partial view of FIG. 1 on a larger scale, showing a recovery receptacle for the calcified deposit according to the invention.

The electric steam iron shown in FIGS. 1 and 2 comprises a casing 1 whose rear forms a heel 2 and a sole 3 heated by an electric resistance 4. The iron can thus have two positions, either an ironing position in which it rests on the sole 3, or a rest position (not shown) in which it rests on the heel 2. The sole 3 has a partition 5 forming with a closure plate 6 a vaporization chamber 7 which is supplied with water from a reservoir 8 and which, on the one hand, is in communication with a steam distribution chamber 9 having steam distribution openings 10 that open to the outside, and, on the other hand, comprises a so-called de-scaling opening 11 opening into a rear position of the iron and plugged by removably mounted closure means.

According to the invention, the closure means comprise a removable receptacle 12 for recovery of the calcified deposit, communicating by a weir 13 with the vaporization chamber 7, so that the calcified deposit present in the vaporization chamber 7 will fall into the receptacle 12 particularly when the iron occupies its rest position.

Thus, each time the user rests the iron on its heel 2, the scales of calcified deposit present in the vaporization chamber 7 will fall into the receptacle 12 in which they are retained. Moreover, thanks to the weir, the calcified scales can also if desired enter into the receptacle 12 in the ironing position, thanks to the to-and-fro movement given to the iron by the user. Thus, this movement gives rise in the vaporization chamber 7 to waves which override the weir 13.

The receptacle 12 is formed for example of a plastic material of the thermosetting type or of the thermoplastic type. Thus, it must withstand the high temperature of the water from the vaporization chamber 7. The plastic material has, in another embodiment, a certain degree of transparency, such as polyester. Thus, it permits the user to control the filling of the receptacle 12.

The de-scaling opening 11 opening into the closure plate 6, the border 11' of said opening thus constitutes in part with the partition 5 of the vaporization chamber 7, said weir 13. The closure plate 6 being ordinarily of sheet aluminum, the de-scaling opening 11 is obtained by simple punching. The manufacturer therefore has no need to modify the existing soles and accordingly saves money on the mold.

The bottom 14 of the receptacle 12 is disposed below the level of the de-scaling opening 11 and the closure means comprise a declivity 15 extending from said opening 11 to the bottom 14 of the receptacle 12, so as to oppose, in the ironing position, the return of the calcified deposit present in the receptacle 12 toward the vaporization chamber 7.

Thus, the declivity 15 permits increasing the quantity of calcified scales stored in the receptacle 12. Thus, during abrupt to-and-fro movements of the iron in the ironing position, the calcified particles come to rest on the declivity 15 and said particles, not being able to pass through the weir 13 toward the vaporization chamber 7, are accordingly trapped in the receptacle 12.

According to a preferred embodiment, the closure means comprise, in addition to the receptacle, a conduit 16 whose one end is mounted liquid-tightly on the outlet of the de-scaling opening 11 and whose other end is provided with a joint 17 that seals with the receptacle 12. The joint 17 is preferably of silicone. The closure plate 6 being separated from the casing 1 by a heat shield 18 of heat resistant plastic material, the conduit 16 is of one piece with said shield 18 and has an inclined region constituting the declivity 15. The heat shield 18 being preferably of plastic material, the conduit 16 is easily produced by molding, without requiring a supplemental piece.

The receptacle 12 and the casing 1 comprise mutual interlocking means.

The interlocking means comprise a rigid abutment 22 integral with the casing 1 and a flexible abutment constituted by the joint 17, such that the receptacle 12 will be enclosed elastically between the casing 1 and the joint 17. Thus, the connection should withstand the pressure created at the vaporization chamber 7 and maintain the seal of the receptacle 12 to avoid any loss of water or steam which would burn the user. The elasticity. of the joint serves this purpose.

According to another preferred characteristic of the invention and as better shown in FIG. 2, the reservoir 8 being removable and disposed in a recess 19 provided in the rear portion of casing 1, the receptacle 12 comprises a finger 20 projecting into an opening 21 provided in the recess 19 and accessible from said recess, such that the receptacle 12 will be disconnectible by pressing on said finger 20.

Thus, to empty the receptacle 12 of its calcified deposit, it suffices for the user to withdraw the reservoir 8 and to push on said finger 20, thus releasing the receptacle. This embodiment is very safe in use, because the receptacle cannot be accidentally disconnected, the finger 20 not being directly accessible from outside the iron.

Figure 3:
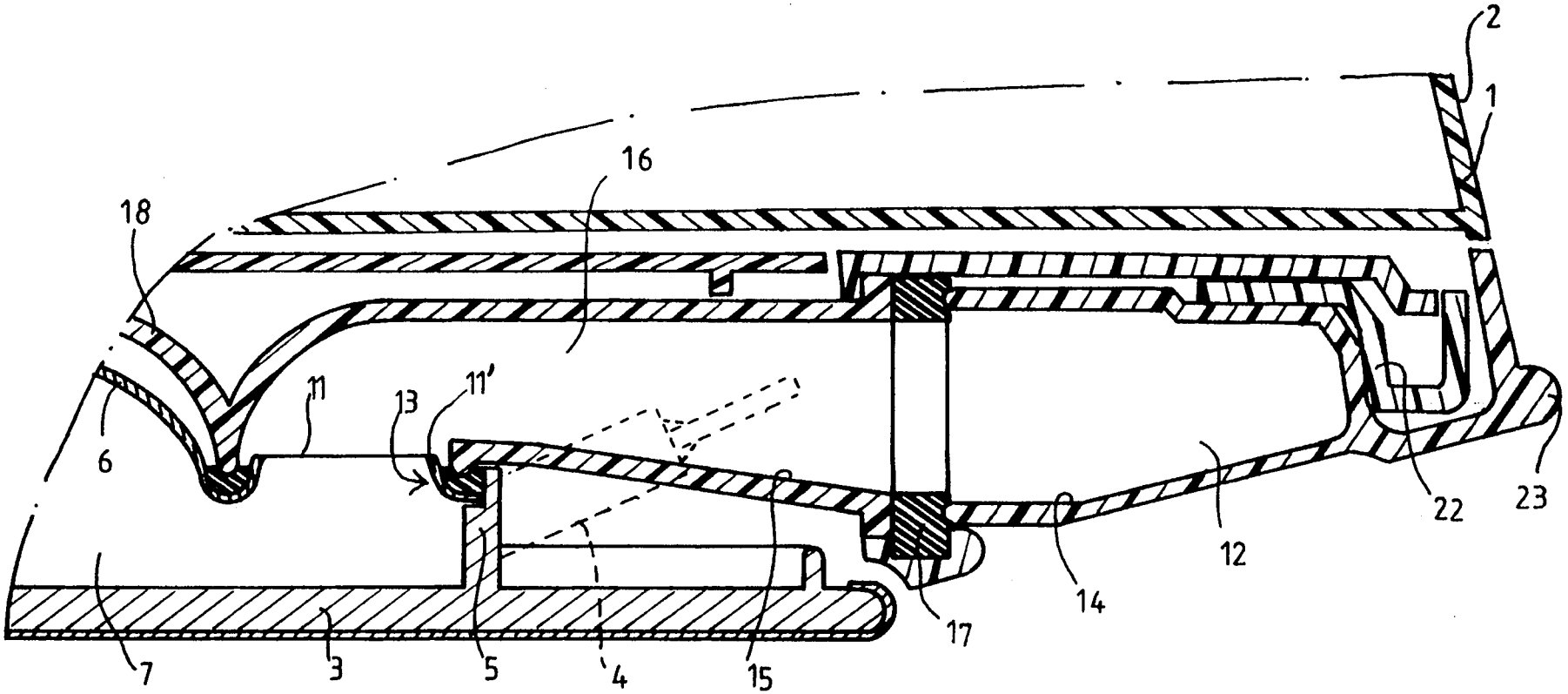
FIG. 3 is a view similar to FIG. 2 showing another embodiment of the invention.

According to another embodiment of the invention as shown in FIG. 3, the receptacle comprises a disconnecting lug 23 located in its rear portion, such that the receptacle 12 will be disconnected by bearing on said lug.

Thus, to empty the receptacle 12 of its calcified deposit, it suffices for the user to push on said lug 23 to release the receptacle 12. This embodiment is particularly simple and specifically adapted to the case in which the reservoir is not removable or else is not disposed in the rear portion of the iron.

What is claimed is:

1. In an electric steam iron comprising a casing (1) whose rear provides a heel (2) and a sole (3) heated by an electric resistance (4), said iron being capable of occupying two positions, either an ironing position in which the iron rests on the sole (3), or a rest position in which the iron rests on the heel (2), said sole (3) having a partition (5) forming with a closure plate (6) a vaporization chamber (7) which is supplied with water from a reservoir (8), said vaporization chamber (7) communicating with a steam distribution chamber (9) having outwardly opening steam distribution openings (10) and having a de-scaling opening (11) opening into a rear portion of the iron and closed by removably mounted closure means; the improvement wherein said closure means comprises a removable receptacle (12) for collecting calcified deposit communicating by a weir (13) with said vaporization chamber (7), whereby calcified deposit present in the vaporization chamber (7) falls into the receptacle (12) when the iron occupies said rest position.

2. Iron according to claim 1, wherein the de-scaling opening (11) opens through the closure plate (6), an edge (11') of said opening constituting with the partition (5) of the vaporization chamber (7) said weir (13).

3. Iron according to claim 1, wherein the receptacle (12) and the casing (1) have mutual interlocking means.

4. Iron according to claim 1, wherein the receptacle has a bottom (14) located below the level of the de-scaling opening (11) and the closure means comprises a declivity (15) extending from said de-scaling opening (11) to the bottom (14) of the receptacle (12), so as to oppose, in the ironing position, the return of calcified deposit present in the receptacle (12) toward the vaporization chamber (7).

5. Iron according to claim 4, wherein the closure means comprises a conduit (16) having two ends, one end being sealingly mounted about the de-scaling opening (11) and the other end being provided with a joint (17) sealing with the receptacle (12).

6. Iron according to claim 5, wherein the closure plate (6) is separated from the casing (1) by a heat shield (18) of heat resistant plastic material, and the conduit (16) is formed in one piece with said shield (18) and has an inclined region constituting the declivity (15).

7. Iron according to claim 5, wherein the receptacle (12) and the casing (1) have mutual interlocking means, said interlocking means comprising a rigid abutment (22) integral with the casing (1) and a flexible abutment constituted by the joint (17), such that the receptacle (12) is housed elastically between the casing (1) and the joint (17).

8. Iron according to claim 7, wherein the reservoir (8) is removable and is disposed in a recess (19) provided in a rear portion of the casing (1), the receptacle (12) having a finger (20) projecting into an opening (21) provided in the recess (19) and accessible from said recess, such that the receptacle (12) is disconnectible by pushing on said finger (20).

9. Iron according to claim 7, further comprising an unlocking lug located in a rear portion of the receptacle (12), whereby the receptacle (12) is disconnectible by pushing on said lug.

10. Iron according to claim 1, wherein the receptacle (12) is of thermosetting plastic material.

* * * * *